US006264828B1

(12) United States Patent
Baker et al.

(10) Patent No.: US 6,264,828 B1
(45) Date of Patent: Jul. 24, 2001

(54) PROCESS, INCLUDING MEMBRANE SEPARATION, FOR SEPARATING HYDROGEN FROM HYDROCARBONS

(75) Inventors: Richard W. Baker, Palo Alto; Kaaeid A. Lokhandwala, Union City; Zhenjie He, Fremont; Ingo Pinnau, Palo Alto, all of CA (US)

(73) Assignee: Membrane Tehnology and Research, Inc., Menlo Park, CA (US)

( * ) Notice: Subject to any disclaimer, the term of this patent is extended or adjusted under 35 U.S.C. 154(b) by 0 days.

(21) Appl. No.: 09/317,106

(22) Filed: May 21, 1999

Related U.S. Application Data

(63) Continuation-in-part of application No. 09/083,660, filed on May 22, 1998.

(51) Int. Cl.[7] ..... C10G 9/00

(52) U.S. Cl. ..... 208/100; 208/102; 208/103; 208/104; 585/802; 585/800

(58) Field of Search ..... 208/108, 100, 208/104; 55/16; 62/9; 585/802, 800

(56) References Cited

U.S. PATENT DOCUMENTS

| | | | | |
|---|---|---|---|---|
| 4,362,613 | | 12/1982 | MacLean | 208/108 |
| 4,367,135 | | 1/1983 | Posey, Jr. | 208/108 |
| 4,548,619 | | 10/1985 | Steacy | 55/16 |
| 4,654,063 | * | 3/1987 | Auvil et al. | 62/18 |
| 4,836,833 | | 6/1989 | Nicholas et al. | 55/16 |
| 4,857,078 | | 8/1989 | Watler | 55/16 |
| 4,892,564 | | 1/1990 | Cooley | 55/16 |
| 4,963,165 | | 10/1990 | Blume et al. | 55/16 |
| 5,053,067 | | 10/1991 | Chretien | 62/24 |
| 5,082,481 | | 1/1992 | Barchas et al. | 62/23 |
| 5,157,200 | | 10/1992 | Mikkinen et al. | 585/803 |
| 5,332,424 | | 7/1994 | Rao et al. | 95/47 |
| 5,354,547 | | 10/1994 | Rao et al. | 423/650 |
| 5,435,836 | | 7/1995 | Anand et al. | 95/45 |
| 5,447,559 | | 9/1995 | Rao et al. | 96/4 |
| 5,507,856 | | 4/1996 | Rao et al. | 95/50 |
| 5,634,354 | | 6/1997 | Howard et al. | 62/624 |
| 5,669,958 | | 9/1997 | Baker et al. | 95/50 |
| 5,689,032 | | 11/1997 | Krause et al. | 585/802 |

OTHER PUBLICATIONS

"Membrane Technology for Hydrocarbon Separation," Membrane Associates Ltd.

"Polymeric Gas Separation Membranes," Paul and Yampolski (eds.).

H. Yamashiro, "Plant Uses Membrane Separation," Hydrocarbon Processing, Jan. 1985.

H. Yamashiro et al., "Hydrogen Purification with Cellulose Acetate Membranes," presented at Europe–Japan Congress on Membranes and Membrane Processes, Jun. 18–21, 1984.

W.A. Bollinger et al., "Optimizing Hydrocracker Hydrogen," Chemical Engineering Progress, May, 1984.

J.A. Abrardo, "Hydrogen Technologies to Meet Refiners' Future Needs," Hydrocarbon Process, Feb. 1995.

W.A.Bollinger et al., "Prism™ Separators Optimize Hydrocracker Hydrogen," Paper presented at AIChE 1983 Summer National Meeting, Session No. 66, Aug. 29, 1983.

* cited by examiner

*Primary Examiner*—Helane E. Myers
(74) *Attorney, Agent, or Firm*—J. Farrant

(57) ABSTRACT

Processes for providing improved methane removal and hydrogen reuse in reactors, particularly in refineries and petrochemical plants. The improved methane removal is achieved by selective purging, by passing gases in the reactor recycle loop across membranes selective in favor of methane over hydrogen, and capable of exhibiting a methane/hydrogen selectivity of at least about 2.5 under the process conditions.

20 Claims, 8 Drawing Sheets

PROCESS, INCLUDING MEMBRANE SEPARATION, FOR SEPARATING HYDROGEN FROM HYDROCARBONS

This application is a continuation-in-part of Ser. No. 09/083,660, filed May 22, 1998, which is incorporated herein by reference in its entirety.

This invention was made in part with Government support under SBIR award number DE-FG03-98ER82618 awarded by the Department of Energy. The Government has certain rights in this invention.

FIELD OF THE INVENTION

The invention relates to improved contaminant removal and hydrogen reuse in hydrocarbon conversion reactors, by passing gases in the reactor recycle loop across selective membranes.

BACKGROUND OF THE INVENTION

Many operations carried out in refineries and petrochemical plants involve feeding a hydrocarbon/hydrogen stream to a reactor, withdrawing a reactor effluent stream of different hydrocarbon/hydrogen composition, separating the effluent into liquid and vapor portions, and recirculating part of the vapor stream to the reactor, so as to reuse unreacted hydrogen. Such loop operations are found, for example, in the hydrotreater, hydrocracker, and catalytic reformer sections of most modern refineries, as well as in isomerization reactors and hydrodealkylation units.

The phase separation into liquid and vapor portions is often carried out in one or more steps by simply changing the pressure and/or temperature of the effluent. Therefore, in addition to hydrogen, the overhead vapor from the phase separation usually contains light hydrocarbons, particularly methane and ethane. In a closed recycle loop, these components build up, change the reactor equilibrium conditions and can lead to reduced product yield. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged. The purge stream may be treated by further separation in some downstream operation, or may simply pass to the plant fuel header.

The impetus for hydrogen recovery in the reactor loop is two-fold. First, demand for hydrogen in refineries and petrochemical plants is high, and it is almost always more cost-effective to try to reuse as much gas as is practically possible than to meet the hydrogen demand entirely from fresh stocks. Secondly, it is desirable in most operations to maintain a high hydrogen partial pressure in the reactor. The availability of ample hydrogen during the reaction step prolongs the life of the catalyst by controlling coke formation, and suppresses the formation of non-preferred, low value products.

Hydrogen recovery techniques that have been deployed in refineries include, besides simple phase separation of fluids, pressure swing adsorption (PSA) and membrane separation. U.S. Pat. No. 4,362,613, to Monsanto, describes a process for treating the vapor phase from a high-pressure separator in a hydrocracking plant by passing the vapor across a membrane that is selectively permeable to hydrogen. The process yields a hydrogen-enriched permeate that can be recompressed and recirculated to the hydrocracker reactor.

U.S. Pat. No. 4,367,135, also to Monsanto, describes a process in which effluent from a low-pressure separator is treated to recover hydrogen using the same type of hydrogen-selective membrane. U.S. Pat. No. 4,548,619, to UOP, shows membrane treatment of the overhead gas from an absorber treating effluent from benzene production. The membrane again permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,082,481, to Lummus Crest, describes removal of carbon dioxide, hydrogen and water vapor from cracking effluent, the hydrogen separation being accomplished by a hydrogen-selective membrane. U.S. Pat. No. 5,157,200, to Institut Francais du Petrole, shows treatment of light ends containing hydrogen and light hydrocarbons, including using a hydrogen-selective membrane to separate hydrogen from other components. U.S. Pat. No. 5,689,032, to Krause/Pasadyn, discusses a method for separating hydrogen and hydrocarbons from refinery off-gases, including multiple low-temperature condensation steps and a membrane separation step for hydrogen removal.

The use of certain polymeric membranes to treat off-gas streams in refineries is also described in the following papers: "Hydrogen Purification with Cellulose Acetate Membranes", by H. Yamashiro et al., presented at the Europe-Japan Congress on Membranes and Membrane Processes, June 1984; "Prism™ Separators Optimize Hydrocracker Hydrogen", by W. A. Bollinger et al., presented at the AIChE 1983 Summer National Meeting, August 1983; "Plant Uses Membrane Separation", by H. Yamashiro et al., in Hydrocarbon Processing, February 1985; and "Optimizing Hydrocracker Hydrogen", by W. A. Bollinger et al., in Chemical Engineering Progress, May 1984. These papers describe system designs using cellulose acetate or similar membranes that permeate hydrogen and reject hydrocarbons. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

Other references that describe membrane-based separation of hydrogen from gas streams in a general way include U.S. Pat. Nos. 4,654,063 and 4,836,833, to Air Products, and U.S. Pat. No. 4,892,564, to Cooley.

U.S. Pat. No. 5,332,424, to Air Products, describes fractionation of a gas stream containing light hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Other Air Products patents that show application of carbon adsorbent membranes to hydrogen/hydrocarbon separations include U.S. Pat. Nos. 5,354,547; 5,435,836; 5,447,559 and 5,507,856, which all relate to purification of streams from steam reformers. U.S. Pat. No. 5,634,354, to Air Products, discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen.

U.S. Pat. No. 4,857,078, to Watler, mentions that, in natural gas liquids recovery, streams that are enriched in hydrogen can be produced as retentate by a rubbery membrane.

The use of rubbery polymeric membranes operated at low temperature to separate methane from nitrogen is taught in U.S. Pat. No. 5,669,958.

SUMMARY OF THE INVENTION

The invention is a process for facilitating purging of a reactor loop in a refinery, petrochemical plant or the like. The process can be applied to any loop in which hydrogen is fed to a reactor, such as a hydrocracker or a catalytic reformer, and in which hydrogen and hydrocarbons are present in the effluent from the reactor. In its most basic aspect, the process of the invention comprises the following steps:

a) withdrawing an effluent stream comprising hydrogen, methane and a $C_{3+}$ hydrocarbon from a reactor;

(b) separating a vapor phase comprising hydrogen, methane and a $C_{3+}$ hydrocarbon from the effluent stream;

(c) passing at least a portion of the vapor phase across the feed side of a membrane separation unit, the membrane separation unit containing a rubbery polymeric membrane having a feed side and permeate side, and being selectively permeable to methane over hydrogen, under conditions sufficient that the membrane exhibits a methane/hydrogen selectivity of at least about 2.5;

(d) withdrawing from the permeate side a permeate stream enriched in methane and $C_{3+}$ hydrocarbon compared with the vapor phase;

(e) withdrawing from the feed side a residue stream enriched in hydrogen compared with the vapor phase;

(f) optionally recirculating at least a portion of the residue stream to the reactor.

The process relies on obtaining a methane/hydrogen selectivity of at least about 2.5, more preferably at least about 3, and most preferably at least about 4 in the membrane separation step. This selectivity, which has hitherto been unknown in any membrane material, is achieved in the preferred case by using a polysiloxane membrane, particularly a silicone rubber membrane. The ability of such a membrane to produce such a comparatively high methane/hydrogen selectivity at low temperature and in the presence of one or more $C_{3+}$ hydrocarbons is unexpected and very advantageous in terms of obtaining useful product streams from the process. Furthermore, under these conditions the membrane exhibits extremely high selectivity for other hydrocarbons over hydrogen, such as 10 or more for ethane/hydrogen and 30 or more for propane/hydrogen.

In another aspect, the invention is reactor apparatus comprising a reactor loop incorporating the reactor itself, the phase separation equipment and the membrane separation unit containing a contaminant-selective membrane.

The invention has an important advantage over other polymeric membrane separation processes that have been used in the industry in the past: all hydrocarbons, including methane, permeate the membrane preferentially, leaving a residue stream on the feed side that is concentrated in the slower-permeating hydrogen.

This means that the membrane provides a selective purge capability. The contaminant purge stream, that is, the permeate stream from the membrane, is substantially depleted in hydrogen. Thus, the proportionate loss of hydrogen per volume of methane purged can be reduced several fold compared with the conventional loop process.

Furthermore, since the hydrogen content of the purge stream is reduced, the hydrogen content of the recirculated stream can be correspondingly increased. Therefore, under some circumstances, the process can provide, per volume of gas purged, a slightly higher hydrogen partial pressure in the reactor than was achieved previously. This is beneficial in increasing catalyst life and suppressing low-value products.

A further particular benefit of our invention is that the hydrogen-enriched stream is retained on the high-pressure side of the membrane. The ability to deliver this as recycle gas without the need for recompression from the comparatively low pressure on the permeate side of the membrane is attractive.

Another important advantage is that polymeric materials are used for the membranes. This renders the membranes easy and inexpensive to prepare, and to house in modules, by conventional industrial techniques, unlike other types of hydrogen-rejecting membranes, such as finely microporous inorganic membranes, including adsorbent carbon membranes, pyrolysed carbon membranes and ceramic membranes, which are difficult and costly to fabricate in industrially useful quantities.

The preferred membranes used in the present invention permeate all of the hydrocarbons, hydrogen sulfide and water vapor preferentially over hydrogen, and are capable of withstanding exposure to these materials even in comparatively high concentrations. This contrasts with cellulose acetate and like membranes, which must be protected from exposure to heavy hydrocarbons and water. If liquid water or $C_{3+}$ hydrocarbons condense on the surface of such membranes, which can happen if the temperature within the membrane modules is lower than the upstream temperature and/or as the removal of hydrogen through the membrane increases the concentration of other components on the feed side, the membranes can suffer catastrophic failure. On the other hand, the membranes used in the invention preferentially and rapidly pass these components, so they do not build up on the feed side. Thus, the membranes can handle a diversity of stream types including, for example, gases produced when feedstocks laden with sulfur are hydroprocessed. This is a differentiating and important advantage over processes that have previously been available.

The membrane separation step may be carried out on the entirety of the effluent stream to be recirculated to the reactor, or may be performed on part of the effluent stream, with another part of the stream being recirculated to the reactor. The membrane step may take the form of a single step or of multiple sub-steps, depending on the feed composition, membrane properties and desired results.

The phase separation step may be carried out in any convenient manner, as a single-stage operation, or in multiple sub-steps. The effluent from hydrocracking reactors and the like is typically at high temperature, so, for example, the phase separation step may involve cooling to liquefy the heavier components of the stream. Alternatively, or in addition, the pressure on a liquid may be lowered to flash off the most volatile materials.

Additional separation steps may be carried out in the loop as desired to supplement the phase separation or membrane separation steps or to remove secondary components from the stream. In particular, the feed stream to the membrane separation step may require additional cooling to reach a temperature at which the specified selectivity is obtained.

Specific exemplary separations to which the process of the invention can be applied include, but are not limited to, separation of light hydrocarbons from hydrogen in off-gas streams from: hydrocrackers; hydrotreaters of various kinds, including hydrodesulfurization units; coking reactors; catalytic reformers; specific isomerization, alkylation and dealkylation units; steam reformers; hydrogenation and dehydrogenation processes; and steam crackers for olefin production.

Most significantly, the invention provides membrane processes that can separate methane from hydrogen with a practical, industrially useful selectivity, and retain the hydrogen at high pressure.

It is to be understood that the above summary and the following detailed description are intended to explain and illustrate the invention without restricting its scope.

DETAILED DESCRIPTION OF THE INVENTION

Figure 1:
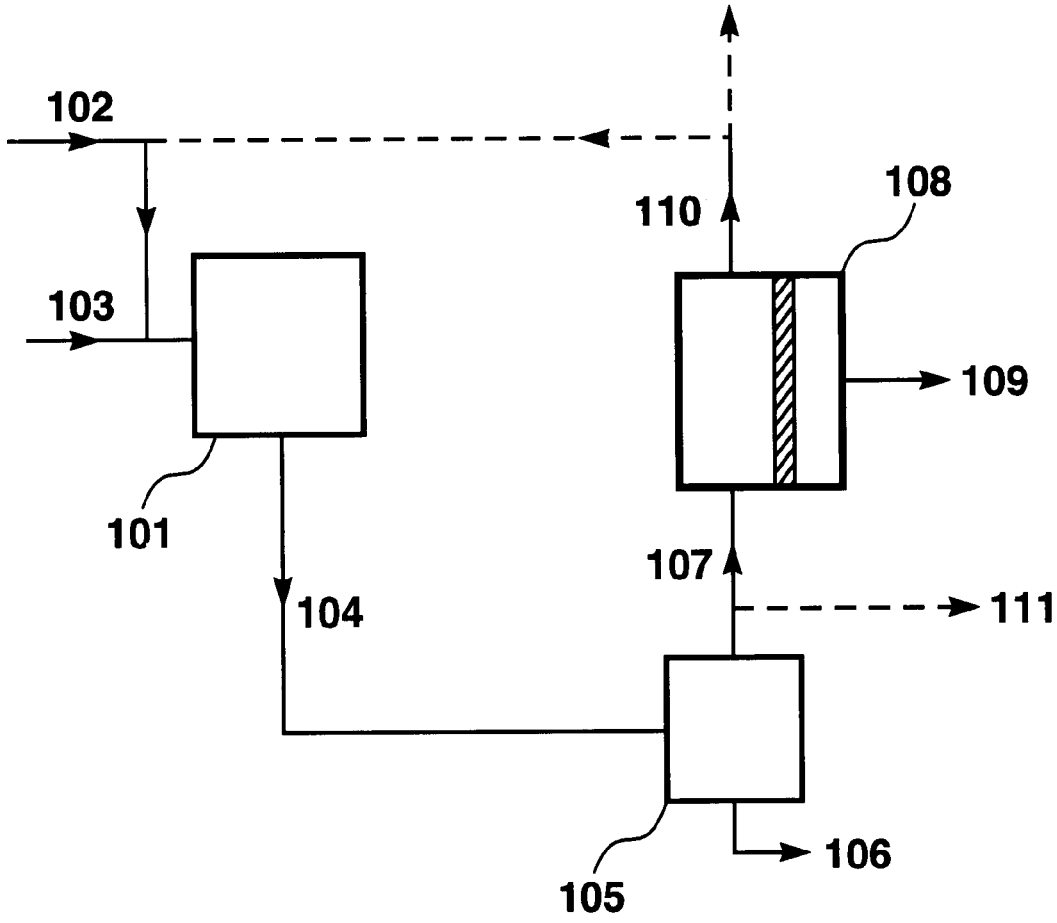
FIG. 1 is a schematic drawing showing a basic embodiment of the invention.

The terms gas and vapor are used interchangeably herein.

The term $C_{2+}$ hydrocarbon means a hydrocarbon having at least two carbon atoms; the term $C_{3+}$ hydrocarbon means a hydrocarbon having at least three carbon atoms; and so on.

The term $C_{2-}$ hydrocarbon means a hydrocarbon having no more than two carbon atoms; the term $C_{3-}$ hydrocarbon means a hydrocarbon having no more than three carbon atoms; and so on.

The term light hydrocarbon means a hydrocarbon molecule having no more than about six carbon atoms.

The term lighter hydrocarbons means $C_1$ or $C_2$ hydrocarbons.

The term heavier hydrocarbons means $C_{3+}$ hydrocarbons.

Percentages herein are by volume unless otherwise stated.

The invention is a process for facilitating purging of a reactor loop in a refinery, petrochemical plant or the like. By a reactor loop, we mean a configuration in which at least a part of the effluent stream from a reactor is recirculated to the reactor. The process can be applied to any loop in which hydrogen is fed to the reactor, and in which hydrogen, methane and one or more $C_{3+}$ hydrocarbons are present in the effluent. The primary goal of the process is to provide selective purging of methane and/or other contaminant gases from the reactor loop, thereby diminishing hydrogen loss from the process. A second goal is to increase recovery of the heavier hydrocarbons from the gases purged from the loop.

In its most basic aspect, the invention is a process that involves separating the effluent from the reactor into liquid and vapor portions, and purging at least some of the vapor portion selectively by using a hydrogen-rejecting, methane-permeating membrane separation unit. The membrane separation unit contains a rubbery polymeric membrane, preferably polysiloxane, that exhibits a methane/hydrogen selectivity of at least about 2.5, more preferably at least about 3 and most preferably at least about 4 under the conditions of separation.

Although it could be used in any field where reactor effluent streams are laden with hydrocarbons and hydrogen, the invention is expected to be of particular use in the fields of oil refining and petrochemical production. Those of skill in the art will appreciate that numerous opportunities exist for its employment in those areas, and that the brief discussion of a few applications that follows is intended to be exemplary rather than limiting.

As a first example, the major consumers of hydrogen in a refinery are the hydroprocessing units. Hydroprocessing covers various refinery operations, including, but not limited to, catalytic hydrodesulfurization (CHD), hydrotreating to remove other contaminants, pretreatment of reformer feedstocks, and hydrocracking to break down polycyclic aromatic compounds. Modern refineries often carry out these operations together, such as in multi-stage reactors, where the first stage predominantly converts sulfur compounds and the second stage predominantly performs the cracking step. In hydroprocessing, fresh feed is mixed with hydrogen and recycle gas and fed to the reactor, where the desired reactions take place in the presence of a suitable catalyst. For example, hydrogen is consumed to form hydrogen sulfide from mercaptans and the like, to form paraffins from olefins, and to open and saturate aromatic rings. As a result, light components formed include methane, ethane and hydrogen sulfide. The reactor effluent enters a separator, usually at high pressure, from which a hydrogen-rich vapor fraction is withdrawn and returned to the reactor. The hydrogen demand varies, depending on the specifics of the operation being performed, and may be as low as 200 scf/bbl or less for desulfurization of naphtha or virgin light distillates, 500–1,000 scf/bbl for treating atmospheric resid, upwards of 1,000 scf/bbl for treatment of vacuum resid, and as high as 5,000–10,000 scf/bbl for hydrocracking.

Not all of this hydrogen is consumed in the reactions. Reactors are generally run with an excess of hydrogen in the feed to protect the catalyst from coke formation, thereby prolonging the cycle time of the reactor. Generous use of hydrogen also promotes high levels of sulfur removal and depresses the formation of unsaturated compounds, which tend to be of lower value in this context.

As a function of these requirements, the light gas fraction recirculated from the separators to the reactors is rich in hydrogen, and may consist of as much as 80 vol % or more hydrogen. Other components are typically $C_1$–$C_3$ hydrocarbons, hydrogen sulfide, heavier hydrocarbons, carbon dioxide, nitrogen, ammonia and other trace materials. If certain of these components, such as methane and hydrogen sulfide, are allowed to build up in the reactor loop, they gradually change the composition of the reactor mix and adversely affect the product yield and the catalyst. The invention can be used to purge methane, hydrogen sulfide and most other components from the loop with very little loss of hydrogen.

Another important exemplary application of the invention is in catalytic reforming, the primary goal of which is to improve the octane quality of gasoline feedstocks. The reformer is a net hydrogen producer, and in most refineries hydrogen thus generated is used in other units, such as the hydrotreaters. In the reformer, the n-paraffin components of virgin or cracked naphthas are converted to higher octane iso-paraffins and aromatics. The process is generally carried out in three reaction zones, in each of which specific reactions are favored. For example, the first zone may perform, among other reactions, dehydrogenation of methylcyclohexane to toluene, the second zone may perform dehydroisomerization, such as conversion of heptane to toluene, and the third zone may perform isomerization of normal to iso-heptane. Although the process is an overall producer of hydrogen, hydrogen is recycled back to the feed to maintain the hydrogen-to-hydrocarbon ratio in the reactors within a range to favor the desired reactions and to prolong the catalyst life.

The gaseous effluent from the reactor series is cooled and separated into liquid and vapor phases. The vapor phase may be subjected to other hydrogen purification steps, and is divided into two streams, one for return to the reformer, the other for use elsewhere in the refinery. The invention can be used as part of the vapor phase treatment, to remove methane and other components from the loop while reducing hydrogen losses.

A third exemplary application is in isomerization, a broad term that covers a variety of specific operations. In the refinery, isomerization is used to improve the quality of light straight-run gasoline by converting normal $C_5$ and $C_6$ paraffins to iso-paraffins. Another important use is conversion of n-butane to iso-butane for alkylate manufacture. Isomerization is used in the petrochemical industry to convert isomers of butene, pentene, hexene and other olefins to preferred forms as feedstocks for other processes, such as MTBE and TAME manufacture. Another important petrochemical application of isomerization is the conversion of other $C_8$ compounds into paraxylene, the starting feedstock for polyester manufacture. Although isomerization reactions themselves do not consume hydrogen, hydrogen is used in the isomerization reactor gas mix to protect the catalyst from coking, and small amounts of hydrogen are consumed by secondary reactions that take place. The layout of the process is often, therefore, similar to those already described; the effluent from the reactors is cooled and separated into liquid and vapor phases, and, after purging as necessary, the vapor phase is recirculated to the reactors. The invention can be used as described above to treat the vapor phase from the separators to provide selective removal of hydrocarbons with little hydrogen loss.

A fourth opportunity for our process is in hydrodealkylation, principally benzene production from toluene. The toluene/benzene conversion is usually performed by cracking at high temperature, such as above 600° C., in the presence of hydrogen. Typically a molar ratio of hydrogen to hydrocarbon of about 4 is used, and the process consumes as much as 1,500 scf of hydrogen per barrel of hydrocarbon processed. In the typical process, toluene, make-up hydrogen and recycle hydrogen are heated and enter the reactor, where toluene and hydrogen react to form benzene and methane. The effluent is withdrawn from the reactor and passed through separators that both cool and reduce the pressure of the effluent. The hydrocarbon liquid mixture that results is stabilized, then the benzene product is separated from the heavier aromatics, at least part of which are recycled to the reactor for further conversion. The vapor phase from the separators is subjected to additional hydrogen purification if necessary and the remaining hydrogen is returned for reuse in the reactor. As can be seen, the opportunity again exists to apply our process in the vapor recirculation loop. Thus the loop can include, in any order as convenient, cooling steps to remove liquid, flashing to remove light components from liquid, membrane separation to selectively purge methane from hydrogen, and other hydrogen purification treatments, such as further membrane treatment by hydrogen-selective, rather than hydrogen-rejecting membranes, pressure swing adsorption, and so on.

The invention in a basic aspect is shown schematically in FIG. 1. Referring to this figure, box 101 represents the reactor. The reactor may be of any type and may perform any hydrocarbon conversion reaction, within the limits of the invention; that is, the reactor feed contains at least hydrogen and hydrocarbons, and the reactor effluent also contains hydrogen and hydrocarbons, but in a different composition. FIG. 1 shows three feed streams: 103, the hydrocarbon feedstock stream; 102, the fresh hydrogen stream; and 110, the recycle stream, entering the reactor. Very commonly, the streams will be combined as shown and passed through compressors, heat exchangers or direct-fired heaters (not shown) to bring them to the appropriate reaction conditions before entering the reactors. Alternatively, the streams can be prepared and fed separately to the reactor. Commonly, the hydrocarbon stream, 103, itself may be a combination of recycled unreacted hydrocarbons and fresh feed.

As mentioned above with respect to the specific applications, one or multiple reactors may be involved in the process, with the individual reactors carrying out the same or different unit operations. The reactor operating conditions are not critical to the invention and can and will vary over a wide range, depending on the function of the reactor. For example, hydrocracking reactions generally require high pressure and temperature, and hydrocrackers run at pressures as high as 1,500–3,000 psig and temperatures as high as 250–400° C. Hydrodealkylation is performed at more modest pressures, but at very high temperatures, such as 600–700° C. Isomerization conditions can be milder, such as 250–400 psig and 250–350° C. Thus, the invention embraces all reactor temperature and pressure conditions.

The effluent stream, 104, is withdrawn from the reactor. Depending upon the conditions in the reactor and/or the exit conditions, this stream may be gaseous, liquid or a mixture of both. The first treatment step required is to separate the stream into discrete liquid and gas phases, shown as streams 106 (liquid) and 107 (vapor) in FIG. 1. This separation step is indicated simply as box 105, although it will be appreciated that it can be executed in one or multiple sub-steps. For example, the effluent from a hydrocracker may be at 350° C. and may be reduced in temperature in three stages to 50° C. In this case, the vapor phase from the first sub-step forms the feed to the second sub-step, and so on. The cooling step or steps may be performed by heat exchange against other plant streams, and/or by using air cooling, water cooling or refrigerants, depending on availability and the desired final temperature. Such techniques are familiar to those of skill in the art. The physical nature of the separator vessel can be chosen from simple gravity separators, cyclone separators or any other convenient type.

If the effluent is in the liquid phase, either directly as it emerges from the reactor or after one or more cooling steps, a fraction consisting of hydrogen and other light gases can be flashed off. Typically, flashing is achieved by letting down the pressure on the liquid, thereby achieving essentially instantaneous conversion of a portion of the liquid to the gas phase. This may be done by passing the liquid through an expansion valve into a receiving tank or chamber, or any other type of phase separation vessel, for example. The released gas can be drawn off from the upper part of the chamber; the remaining liquid can be withdrawn from the bottom. Flashing may be carried out in a single stage, or in multiple stages at progressively lower pressures. If multiple flash stages are used, each will generate its own vapor overhead stream.

From the above description, it is clear that the liquid phase from the separation step may be in the form of one or multiple streams. The liquid stream or streams, indicated generally as 106 in FIG. 1, pass to downstream destinations and/or treatment as desired.

The vapor phase may also be in the form of one or multiple streams, and any one of these, or combinations of these, may be recirculated to the reactor within the scope of the invention. For example, in prior art reactors operating at elevated temperatures and pressures, the phase separation step is commonly carried out first by maintaining the effluent at a relatively high pressure, but cooling it, yielding a comparatively hydrogen-rich vapor phase. The liquid from this step is then let down to a lower pressure, thereby flashing off a light gas fraction. This light gas fraction, which tends to be leaner in hydrogen and richer in light hydrocarbons than the vapor from the high pressure separation step, is usually not recirculated to the reactor, but is sent to the fuel gas line.

The process of the invention may be carried out according to this scheme, so that only the most hydrogen-rich of the vapor fractions forms stream 107. Alternatively, stream 107 may comprise vapor from a lower pressure separation step, or both the higher and lower pressure streams may be treated and optionally recirculated with the loop.

Stream 107 passes as feed to the membrane purge step, shown as 108 in FIG. 1. The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{3+}$ organic molecules. For rubbery or elastomeric polymers, the difference in size is much less critical, because the polymer chains can be flexed, and sorption effects generally dominate the permeability. Elastomeric materials, therefore, tend to permeate larger, condensable molecules faster than small, low-boiling molecules. Thus, most rubbery materials are selective in favor of all $C_{3+}$ hydrocarbons over hydrogen. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrene/butadiene/styrene block copolymers, styrene/ethylene/butylene block copolymers, and thermoplastic polyolefin elastomers. For the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2. Therefore, although any of the rubbery membrane materials mentioned above are useful for providing separation of $C_{2+}$ hydrocarbons from hydrogen, even most rubbery materials are unsuitable for use in the present invention. Materials that are useful within the scope of the invention are those rubbery polymers that are selective in favor of methane over hydrogen. To applicants' knowledge, among the polymeric membranes that perform gas separation based on the solution/diffusion mechanism, silicone rubber, specifically polydimethylsiloxane (PDMS) and closely related polymers are the only materials that are selective in favor of methane over hydrogen, and thus are potentially useful within the scope of the invention. Other materials that we expect may be found to be methane/hydrogen selective include other polysiloxanes, such as other alkyl-substituted siloxanes, copolymers of PDMS or other alkyl-substituted siloxane with other materials, and the like. For example, U.S. Pat. No. 4,370,150 cites data for silicone-polycarbonate copolymer membranes that suggest a pure gas selectivity of about 1.3 for methane over hydrogen, but this would, of course, depend on the exact composition of the polymer and the other components of an actual gas.

As mentioned above, the invention relies on obtaining a methane/hydrogen selectivity of at least about 2.5, more preferably at least about 3, and most preferably at least about 4 in the membrane separation step. However, such a selectivity is currently unknown from any membrane material at temperatures above 0° C. Our experiments with silicone rubber films and binary methane/hydrogen mixtures at subzero temperatures showed that the methane/hydrogen selectivity increases only slightly with decreasing temperature, from about 1.4 at 20° C. to about 1.9 at −20° C. Furthermore, the permeability of silicone rubber to both hydrogen and methane drops with decreasing temperature. Unexpectedly, however, in a multicomponent mixture containing hydrogen, methane and $C_{3+}$ hydrocarbons, the permeability of silicone rubber to methane was no longer found to decrease with decreasing temperature, but now to increase with decreasing temperature, a trend opposite to that observed with the binary gas mixture. In the same multicomponent mixture, however, the hydrogen permeability continues to decrease with decreasing temperature, resulting in a substantial increase in methane/hydrogen selectivity. In tests with silicone rubber films of a few hundred microns thickness, we found that a methane/hydrogen selectivity of 3, 4 or even 5 or more can be obtained when the film is exposed to a stream containing hydrogen, methane and a $C_{3+}$ hydrocarbon at sub-zero temperatures, such as −5° C. or −20° C. Using composite membranes of just a few microns thick in membrane modules, such as will be used in an actual industrial separation process, instead of thick silicone rubber films, it is necessary to go to slightly lower temperatures to achieve comparable performance. For example, a methane/hydrogen selectivity of 4 may be attained from a laboratory film at −20° C., but it may be necessary to go to −30° C. to attain that same same selectivity from a module in an industrial plant. On this basis, the preferred operating temperature for the membrane separation step 108 is in the range 0° C. to −40° C.

For some specific gas mixture/membrane material combinations, it may be possible to obtain a selectivity within the desired range even at a temperature slightly above 0° C. In this case, operation at such a temperature will obviously reduce cooling costs and will be convenient if water vapor is present in the feed stream. On the other hand, the membrane separation performance may be less than would be achieved by operating at lower temperature.

Figure 2:
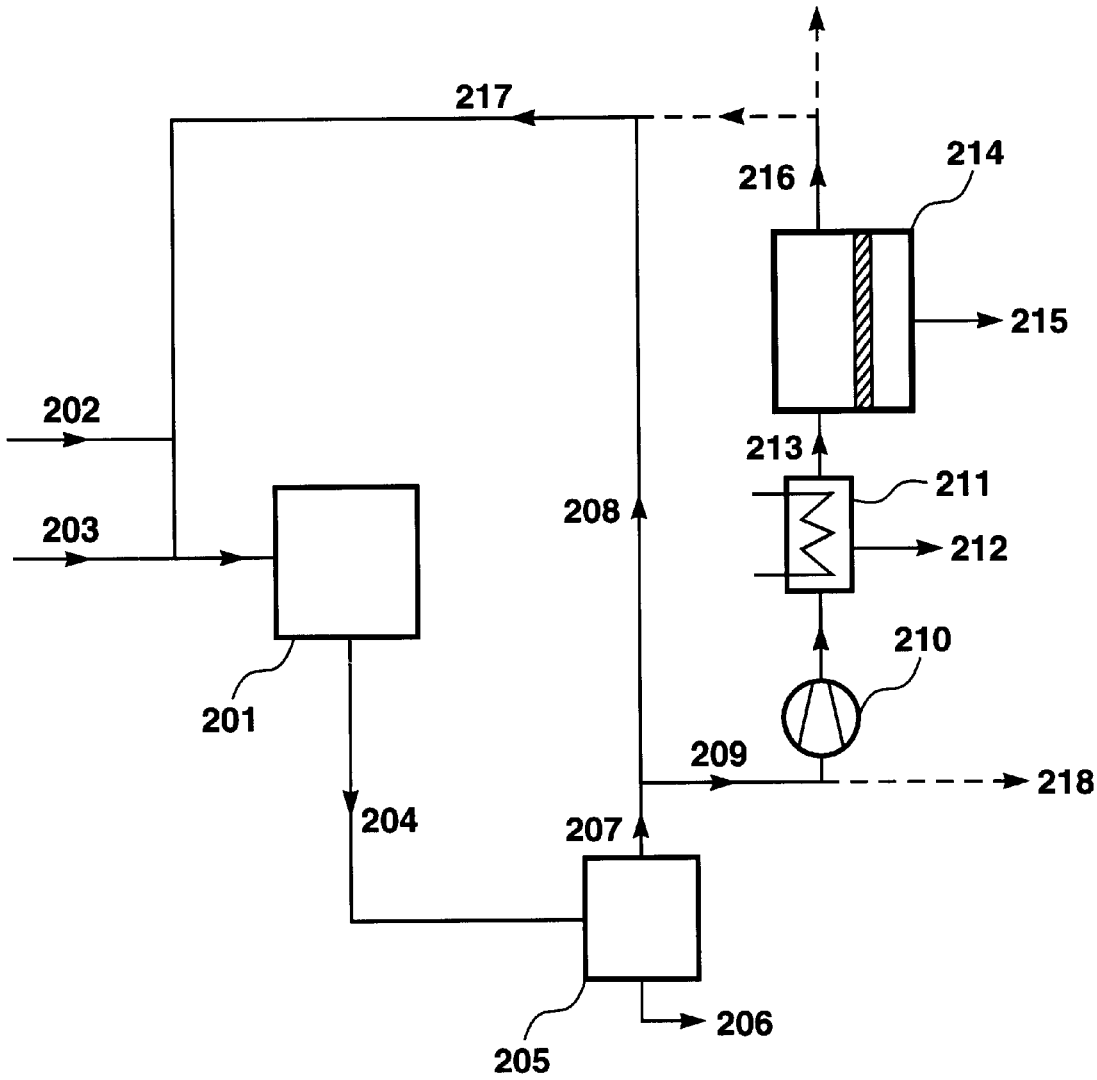
FIG. 2 is a schematic drawing showing an embodiment of the invention in which the feed to the membrane modules is compressed and cooled.

Depending on the hydrocarbon conversion reaction that is performed in step 101 and the conditions under which the liquid/vapor phase separation is performed in step 105, the feed stream 107 to the membrane separation step may already be at a suitable temperature to yield the desired methane/hydrogen selectivity. For example, separation of the raw liquid reformate from a catalytic reformer may be carried out in a two-stage process in which the second stage is performed at low temperature, such as −20° C. or below. In other cases, the overhead vapor may be comparatively warm, such as at 100° C., 200° C. or higher, and stream 107 may require substantial additional cooling, not shown in FIG. 1, to reach a temperature that will provide adequate selectivity. In that case, embodiments such as that described below with respect to FIG. 2 are preferred.

The membrane separation step is used to purge methane and other contaminants from the recycle loop; this purged contaminant portion is removed as permeate stream 109, and may be sent to the fuel line or any other desired destination. The membranes permeate all hydrocarbons, hydrogen sulfide, carbon monoxide, carbon dioxide, water vapor and ammonia faster than hydrogen. Thus, permeate stream 109 is substantially enriched in hydrocarbons, and the other components mentioned above, if they are present, and depleted in hydrogen, compared with feed stream 107. Those of skill in the art will appreciate that the membrane area and membrane separation step operating conditions can be varied depending on whether the component of most interest to be enriched in the permeate is methane, ethane, a $C_{3+}$ hydrocarbon, hydrogen sulfide or some other material. For example, the concentration of propane might be raised from 2 vol % in the feed to 10 vol % in the permeate, or the hydrogen sulfide concentration might be raised from 5% to 20%. Correspondingly, the hydrogen content might be diminished from 75 vol % in the feed to 50 vol % in the permeate.

This capability can be used to advantage in several ways. In one aspect, the mass of a specific contaminant purged from the reactor recycle loop can be controlled. Suppose reactor conditions and flow rates are such that it is necessary, by whatever means, to remove 2,500 lb/h of total hydrocarbons from the reactor loop. Without the membrane separation step, this level of removal might result in the purging and loss of 600 lb/h of hydrogen. By purging the permeate stream, a flow of 2,500 lb/h of hydrocarbons can be removed by purging only 350 lb/h of hydrogen. This has two immediate benefits. On the one hand, the purge stream is much more concentrated in hydrocarbons than would have been the case if an unselective purge had been carried out. This facilitates further separation and recovery of the hydrocarbons downstream. On the other hand, the hydrogen loss with the purge is reduced, in favorable cases to half or less of what it would be if unselective purging were practiced.

In another aspect, the process can provide a lower level of contaminants in the reactor. Suppose it is desired to operate the reactor at the lowest practical hydrogen sulfide content in the reactor gas mix, while maintaining hydrogen recovery from the vapor stream at 50%. Absent the membrane separation step, this would be accomplished by dividing stream 107 in half, directing one half to the purge, the other back to the reactor. Suppose this had the effect of returning 400 lb/h of hydrogen sulfide to the reactor and purging 400 lb/h of hydrogen sulfide. By passing the purge stream through the membrane separation unit, however, a permeate purge stream is created that has less hydrogen per unit of hydrogen sulfide than was present in the feed. In this case, loss of 50% hydrogen into the permeate purge is accompanied by a higher loss of hydrogen sulfide, say 600 lb/h in the permeate stream. Thus, the hydrogen recovery can be maintained at the desired level, but results in a lesser amount of hydrogen sulfide per pass (only 200 lb/h) being returned to the reactor mix. This provides a mechanism for improving the reactor conditions, and may enable the feed throughput of the reactor to be increased, and/or the cycle time to be extended.

In yet another aspect, by selectively removing the non-hydrogen components, the process results in a membrane residue stream, 110, that is enriched in hydrogen content compared with stream 107. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, the purge becomes progressively less selective. This can be clearly seen by considering that, in the limit, if the stage-cut were allowed to go to 100%, all of the gas present in the feed would pass to the permeate side of the membrane and the purge would become completely unselective. Since the purpose of the invention is to control or diminish loss of hydrogen by selective purging, a very high stage-cut, and hence a high hydrogen concentration in the residue, defeats the purpose of the invention. It is preferred, therefore, to keep the stage-cut low, such as below 50%.

An advantage of using a hydrogen-rejecting membrane is that the hydrogen-rich stream remains on the high-pressure side of the membrane. This reduces recompression requirements for recirculating this stream in the reactor loop, compared with the situation that would obtain if a hydrogen-selective membrane were to be used. In that case, the permeate stream might be at only 10% or 20% the pressure of the feed, and would need substantial recompression before it could be returned to the reactor.

A benefit of using polysiloxane membranes is that they provide much higher transmembrane fluxes than conventional glassy membranes. For example, the permeability of silicone rubber to methane is 800 Barrer, compared with a permeability of only less than 10 Barrer for 6FDA polyimide or cellulose acetate.

The membrane may take any convenient form known in the art. The preferred form is a composite membrane including a microporous support layer for mechanical strength and a rubbery polymeric coating layer, most preferably silicone rubber, that is responsible for the separation properties. Additional layers may be included in the structure as desired, such as to provide strength, protect the selective layer from abrasion, and so on.

The membranes may be manufactured as flat sheets or as fibers and housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. Since conventional polymeric materials are used for the membranes, they are relatively easy and inexpensive to prepare and to house in modules, compared with other types of membranes that might be used as hydrogen-rejecting membranes, such as finely microporous inorganic membranes, including adsorbent carbon membranes, pyrolysed carbon membranes and ceramic membranes.

To achieve a high flux of the preferentially permeating hydrocarbons, the selective layer responsible for the separation properties should be thin, preferably, but not necessarily, no more than 30 $\mu$m thick, more preferably no more than 20 $\mu$m thick, and most preferably no more than 10 $\mu$m thick. Although composite membranes with silicone rubber selective layers of just 1 or 2 $\mu$m thick can be made, extremely thin membranes, such as less than about 5 $\mu$m thick, are not preferred, since the resulting extremely high fluxes may give rise to a permeant-depleted boundary layer at the membrane surface on the feed side, and hence to overall diminished separation performance.

A driving force for transmembrane permeation is provided by a pressure difference between the feed and permeate sides of the membrane. As mentioned above, at least some of the reactions within the scope of the invention will involve high pressure conditions in the reactor, and at least some of the phase separation steps will maintain the vapor at a high pressure, such as 200 psig, 500 psig or above. Feed pressures at this level will be adequate in many instances to provide acceptable membrane performance. In favorable cases such as this, the membrane separation unit requires no additional compressors or other pieces of rotating equipment than would be required for a prior art process without selective purging. The residue stream remains at or close to the pressure of the separator overhead, subject only to a slight pressure drop along the feed surface of the membrane modules, and can, therefore, be sent to a recycle compressor of essentially the same capacity as would have been required in the prior art system. If the pressure of stream 107 is insufficient to provide adequate driving force, a compressor may be included in line 107 between the phase separation step and the membrane separation step to boost the feed gas pressure.

Depending on the composition of the membrane feed stream 107, a single-stage membrane separation operation may be adequate to produce a permeate stream with an acceptably high contaminant content and low hydrogen content. If the permeate stream requires further separation, it may be passed to a second bank of modules for a second-stage treatment. If the second permeate stream requires further purification, it may be passed to a third bank of modules for a third processing step, and so on. Likewise, if the residue stream requires further contaminant removal, it may be passed to a second bank of modules for a second-step treatment, and so on. Such multistage or multistep processes, and variants thereof, will be familiar to those of skill in the art, who will appreciate that the membrane separation step may be configured in many possible ways, including single-stage, multistage, multistep, or more complicated arrays of two or more units in series or cascade arrangements.

Stream 110 is withdrawn from the membrane separation step and may be sent to any destination, although it is preferably recirculated to the reactor inlet. Following the phase separation and membrane separation steps, some small amount of recompression is usually needed to bring stream 110 back to reactor pressure, and this can be accomplished by directing stream 110 through a compressor, not shown in FIG. 1. Alternatively, if a compressor is in use to raise the pressure of streams 102 and/or 103, stream 110 may be directed to the inlet side of this compressor. Such variants will be easily determined based on the present teachings, and are within the scope of the invention.

As an alternative to recirculation, part or all of stream 110 may be discharged from the process for further treatment or use elsewhere, as shown in the figure. For example, in catalytic reformers and other hydrogen-producing reactors, a substantial portion of the hydrogen-rich vapor may be withdrawn for additional treatment, if necessary, followed by use in the hydrogen-consuming reactors, such as hydrotreaters and hydrocrackers.

It will be appreciated by those of skill in the art that the selective purge provided by the membrane separation step may be augmented by conventional purging of a portion of stream 107 directly from the loop if desired, as indicated by dashed arrow 111. This reduces the amount of gas that has to be processed by the membrane separation unit and can be attractive economically for some applications.

FIG. 1 can also be used to show the basic elements of the apparatus of the invention in its simplest embodiment. In this respect, lines 103, 102 and 110, carrying the hydrocarbon feedstock, the fresh hydrogen supply and the recycle hydrogen, respectively form the feed stream inlet line to reactor, 101. The reactor is capable of carrying out the type of hydrocarbon conversions described, and has an effluent outlet line, 104, through which fluid can pass, either directly as shown or via some intermediate treatment, to the phase separator or separators, 105. The phase separator has a liquid outlet line, 106, and a vapor outlet line, 107. The vapor outlet line is connected, either directly as shown, or via intermediate equipment as appropriate, to the feed side of membrane separation unit, 108. This unit contains membranes that are selective in favor of a light hydrocarbon over hydrogen, so as to produce a hydrocarbon-enriched permeate stream and a hydrocarbon-depleted, hydrogen-enriched residue stream. The membrane unit has a permeate outlet 109 and a residue, feed-side outlet, 110, which is optionally connected so that the hydrogen-enriched residue gas can be passed back into the reactor. Dashed line 111 is an optional purge outlet line.

FIG. 2 shows an embodiment of the invention in which the feed stream is compressed and cooled before passing to the membrane separation unit. This embodiment is particularly preferred in that it provides a selective purge capability without requiring the entirety of the overhead stream to be cooled to sub-zero temperature. Referring to this figure, box 201 represents the reactor, which may be of any type as described with respect to FIG. 1. Streams 203, the hydrocarbon stream, 202, the fresh hydrogen stream and 217, the recycle stream are brought to the desired conditions and passed into the reactor. Effluent stream 204 is withdrawn and enters phase separation step 205, which can be executed in any convenient manner, as described for FIG. 1 above. Liquid phase, 206, is withdrawn. Vapor phase, 207, is divided into two streams, 209, which is passed to the membrane separation step, 214, and 208, which bypasses the membrane separation step and is recirculated without further separation and with optional booster recompression, not shown, to the reactor. If desired, an optional additional direct purge cut may be taken as shown by dashed line 218, and sent directly to downstream treatment or use, without passing through the membrane treatment step. Before entering the membrane modules, stream 209 is raised in pressure by passing through compressor 210. Of course, in some instances, stream 209 is already at high pressure, so that compressor 210 may be omitted. The stream is then cooled in heat exchanger or chiller, 211. As discussed above with respect to FIG. 1, the preferred temperature to which stream 209 should be cooled before passing to the membrane separation step 214 is in the range −0° C. to −40° C., with slightly higher temperatures above 0° C. bringing advantages if they are found to be workable to provide adequate selectivity.

Cooling the gas stream results in the formation of a further liquid fraction, 212. This additional heavier hydrocarbon enriched liquid product can be mixed with stream 206, added to other LPG sources in the plant, or otherwise handled as desired. The remainder of the stream, still in vapor form, passes on as stream 213 to membrane separation step or unit 214. The requirements for the membrane are the same as those discussed above with respect to FIG. 1, namely that it be a rubbery polymeric membrane capable of exhibiting a methane/hydrogen selectivity of at least about 2.5, more preferably at least about 3 and most preferably at least about 4 under the conditions of the process. Polysiloxane membranes are preferred, and silicone rubber membranes are most preferred. The membrane separation step produces purge stream 215, enriched in methane and $C_{3+}$ hydrocarbons and depleted in hydrogen, and hydrogen-enriched residue stream 216. Stream 216 may be mixed with stream 208 to form recycle stream 217, or may be sent to another destination, such as for direct use as a hydrogen source in another operation, or for additional treatment, for example by PSA, to produce a higher purity hydrogen product. Stream 215 may be used as fuel gas or sent to any other destination as desired. In yet another variant of the FIG. 2 embodiment, a portion or all of stream 215 can be returned to the inlet side of compressor 210.

In designs such as FIG. 2, purge stream 215 is depleted both in hydrogen and in $C_{3+}$ hydrocarbons compared with stream 209, because some of the more condensable hydrocarbons exit the loop at stream 212. This has the effect of considerably reducing both the volume and the Btu value of the gas purged from the loop, compared with the case if stream 209 were to be purged without treatment. This result is particularly useful in plants where reactor throughput was previously limited by fuel gas production. The generation of less and lighter fuel gas enable the reactor space velocity to be increased, and thus provides a debottlenecking capability.

Embodiments of this type can be used conveniently to retrofit a prior art system by adding the membrane separation unit and optionally the other components in the side loop from line 209 to line 216. Such embodiments provide versatility to adapt to variable compositions and flow rates of stream 207 by diverting greater or lesser proportions of the stream through bypass line 208. They also provide for the membrane separation system to be taken off-line for maintenance or repair without having to shut down the reactor.

Figure 3:
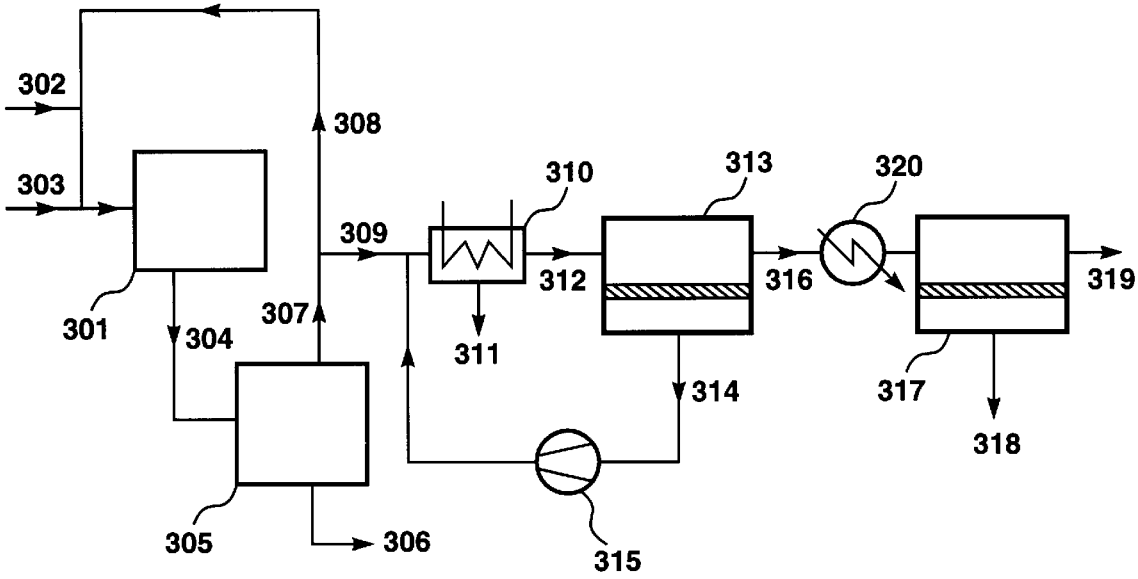
FIG. 3 is a schematic drawing showing an embodiment of the invention using a two-step membrane separation process.

FIG. 3 shows a particularly preferred variant of the FIG. 2 embodiment. Referring to this figure, box 301 represents the reactor, which may be of any type as described with respect to FIG. 1. Streams 303, the hydrocarbon stream, 302, the fresh hydrogen stream and 308, the recycle stream are brought to the desired conditions and passed into the reactor. Effluent stream 304 is withdrawn and enters phase separation step 305, which can be executed in any convenient manner, as described for FIG. 1 above. Liquid phase, 306, is withdrawn. Vapor phase, 307, is divided into two streams, 308, which is recirculated to the reactor, and 309, which is withdrawn from the reactor loop. Stream 309 is cooled in heat exchanger or chiller, 310, resulting in the formation of a further liquid fraction, 311. The remainder of the stream, still in vapor form, passes on as stream 312 to first membrane separation step or unit 313. In this case, two membrane separation steps are used, 313 and 317, and it not necessary that step 313 provide a high methane/hydrogen selectivity of 2.5 or more. Thus, although silicone rubber membranes are still most preferred, other membranes taught in parent application Ser. No. 09/083,660, such as rubbery membranes that are selective for $C_{2+}$ hydrocarbons over hydrogen and superglassy polymers, may be used in this step. Also, the step may optionally be operated at a higher temperature, such as above 0° C. This reduces the overall cooling load of the process. In addition, any water vapor present in the feed gas will permeate the membrane, be recirculated in stream 314 and be removed from the process in stream 311. The first membrane separation step produces permeate stream 314, enriched in $C_{3+}$ hydrocarbons and depleted in hydrogen. This hydrocarbon-enriched stream is recompressed in compressor 315 and recirculated to cooling/condensation step 310 for additional recovery of LPG. Hydrogen-enriched residue stream 316, now depleted in water vapor, if originally present, is withdrawn and passed to second membrane separation step 317. The requirements for the membranes used in this step are the same as those discussed above with respect to FIG. 1, namely that they be rubbery polymeric membranes capable of exhibiting a methane/hydrogen selectivity of at least about 2.5, more preferably at least about 3 and most preferably at least about 4 under the conditions of the process. Thus, for this step, polysiloxane membranes are preferred, and silicone rubber membranes are most preferred, and the preferred temperature operating range for the membrane is between 0° C. and −40° C. Because stream 316 has been dried by the first membrane separation step, sub-zero temperatures can now be used for the second membrane separation step without concern about ice formation.

As the gas has already passed through the first membrane separation step, stream 316 is substantially lighter in $C_{3+}$ hydrocarbon content than stream 312. However, stream 316 is usually as much as 5° C., 10° C., 15° C. or more colder than membrane feed stream 312 as a result of Joule-Thomson cooling brought about by permeation of condensable hydrocarbons, and, as the temperature of the feed gas drops, less of the $C_{3+}$ hydrocarbon gas is required to maintain the membrane selectivity above about 2.5.

If stream 316 is not at a temperature low enough to provide the required selectivity in unit 317, it may be subjected to further optional cooling, 320 as indicated before being introduced into unit 317. The second membrane separation step produces methane-enriched and hydrogen-depleted permeate purge stream, 318, which is sent to fuel gas or otherwise disposed of, and hydrogen-enriched residue stream 319, which may be recirculated to reactor 301, used elsewhere in the plant or sent to a PSA unit or the like for generation of high-purity hydrogen.

The invention is now illustrated in further detail by specific examples. These examples are intended to further clarify the invention, and are not intended to limit the scope in any way.

EXAMPLES

Example 1

Preparation of Silicone Rubber Films

Dense, isotropic films of silicone rubber (polydimethylsiloxane) [PDMS] were made from a 4-wt % solution of silicone rubber in iso-octane (Silicone Dehesive 940 A, Wacker Silicone Corp., Adrian, Mich. The silicone rubber solution contained a crosslinker (V 24) and a platinum-based catalyst. The solution was cast on a glass plate, and the solvent was evaporated at ambient conditions for one week. The films were then dried in a vacuum oven at 80° C. for 12 hours. The thickness of the resulting films was determined with a precision micrometer. Film samples with thicknesses of 100–300 $\mu$m (±1 $\mu$m) were used for the permeation experiments.

Example 2

Permeation Properties of Silicone Rubber Films with a Binary Gas Mixture

An experiment was carried out to determine the performance of silicone rubber films at different temperatures. Films were prepared as in Example 1. Samples of the films were cut into 12.6-$cm^2$ stamps, and subjected to permeation tests in a permeation test-cell apparatus. The tests were performed using the constant pressure/variable volume method, with a gas mixture containing 50% hydrogen and 50% methane. The feed pressure was 150 psig, the permeate pressure was atmospheric (0 psig), and the feed temperature was varied between −20° C. and 35° C. The compositions of the residue and permeate were determined with a gas chromatograph equipped with a thermal conductivity detector, and permeabilities were calculated. The methane/hydrogen selectivity was calculated from the ratio of the permeabilities. The stage-cut, that is, the ratio of permeate to feed flow rate, was always less than 1%.

Figure 4:
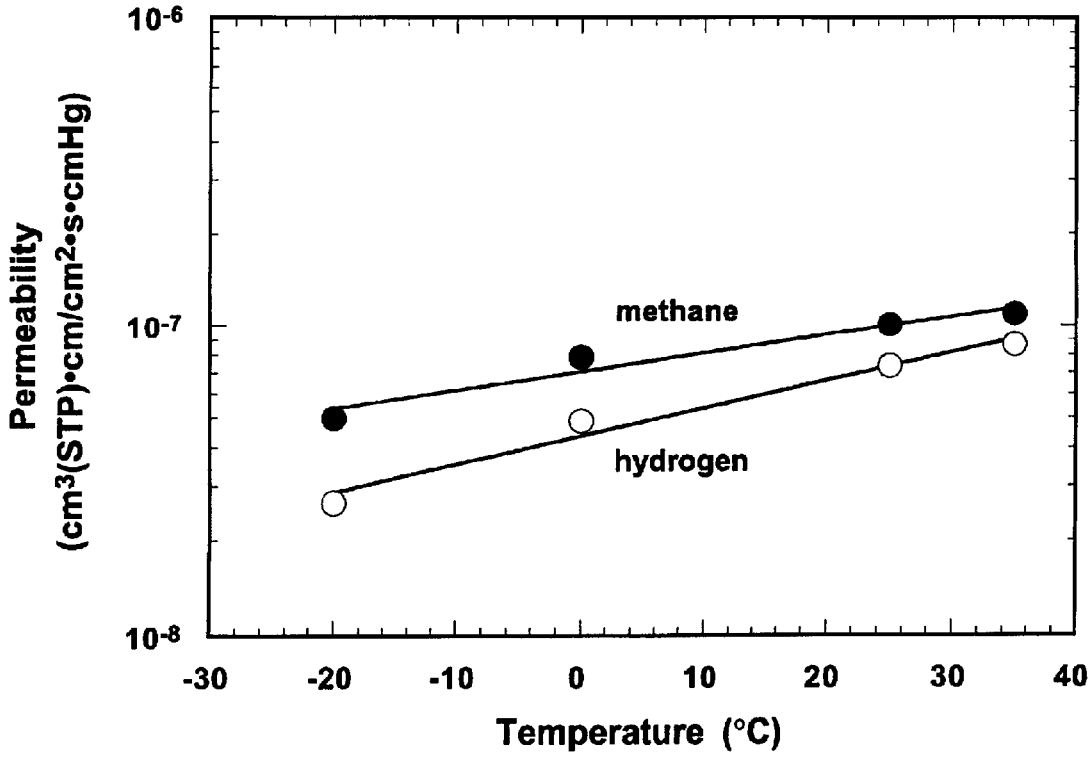
FIG. 4 is a graph showing the effect of temperature on the permeabilities of methane and hydrogen in a binary gas mixture through a silicone rubber film.
Figure 5:
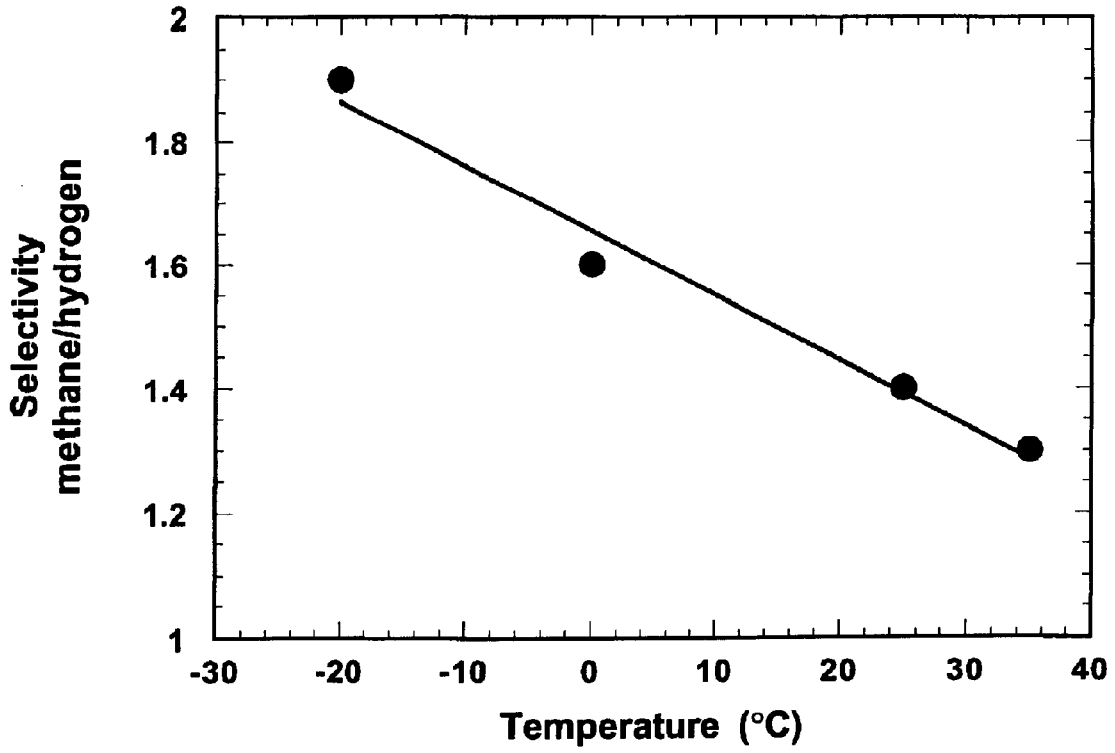
FIG. 5 is a graph showing the effect of temperature on the methane/hydrogen selectivity of a silicone rubber film measured with a binary gas mixture.

Permeability and selectivity results are shown in FIGS. 4 and 5, respectively, as a function of temperature. The methane and hydrogen permeabilities both decreased with decreasing feed temperature. The silicone rubber film was more permeable to methane than to hydrogen over the whole temperature range. Because the hydrogen permeability of silicone rubber exhibited a stronger temperature dependence than that of methane, the methane/hydrogen selectivity increased slightly from about 1.3 at 35° C. to about 1.9 at −20° C., as shown in FIG. 5.

Example 3

Permeation Properties of Silicone Rubber Films with Pure Gases

Figure 6:
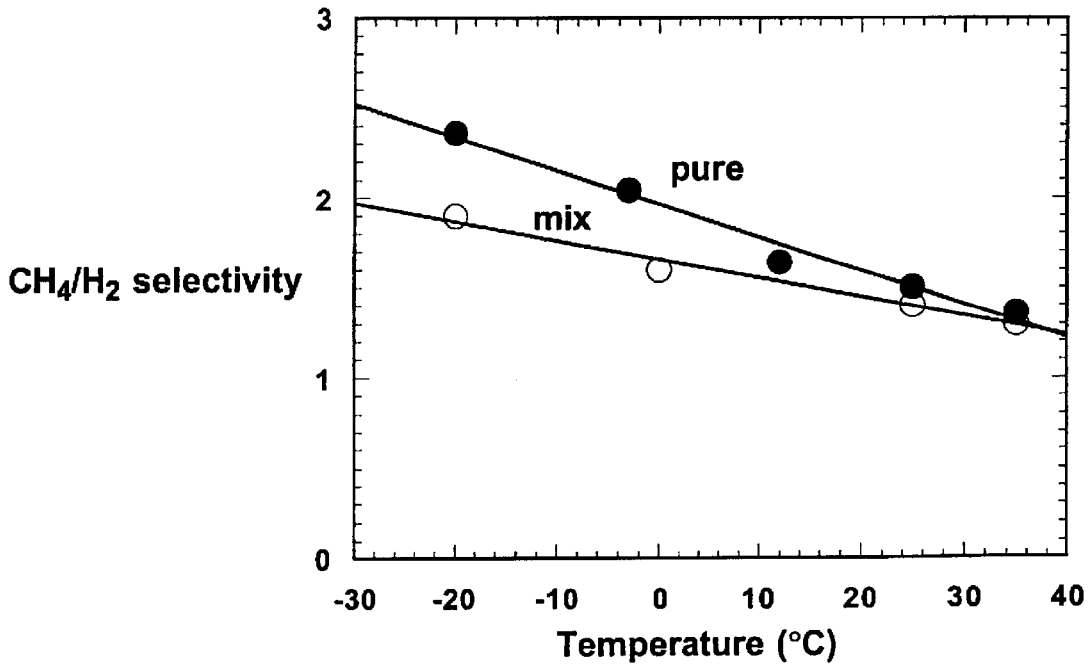
FIG. 6 is a graph comparing the effect of temperature on the methane/hydrogen selectivity of a silicone rubber film as measured with pure gases and with a binary gas mixture.

The experiment of Example 2 was repeated with pure hydrogen and pure methane. All experimental conditions were as in Example 2. The pure gas fluxes of the films were measured, and the methane/hydrogen selectivity was calculated. FIG. 6 compares the calculated pure gas methane/hydrogen selectivity to the mixed-gas methane/hydrogen selectivity obtained in Example 2.

Example 4

Permeation Properties of Silicone Rubber Films with a Multicomponent Gas Mixture The experiment of Example 2 was repeated with a gas mixture containing 50 vol % hydrogen, 19 vol % methane, 19 vol % ethane, 10 vol % propane, and 2 vol % n-butane. All experimental conditions were as in Example 2. The compositions of the residue and permeate were determined with a gas chromatograph equipped with a thermal conductivity detector, and permeabilities were calculated. The hydrocarbon/hydrogen selectivities were calculated from the ratios of the permeabilities.

Figure 7:
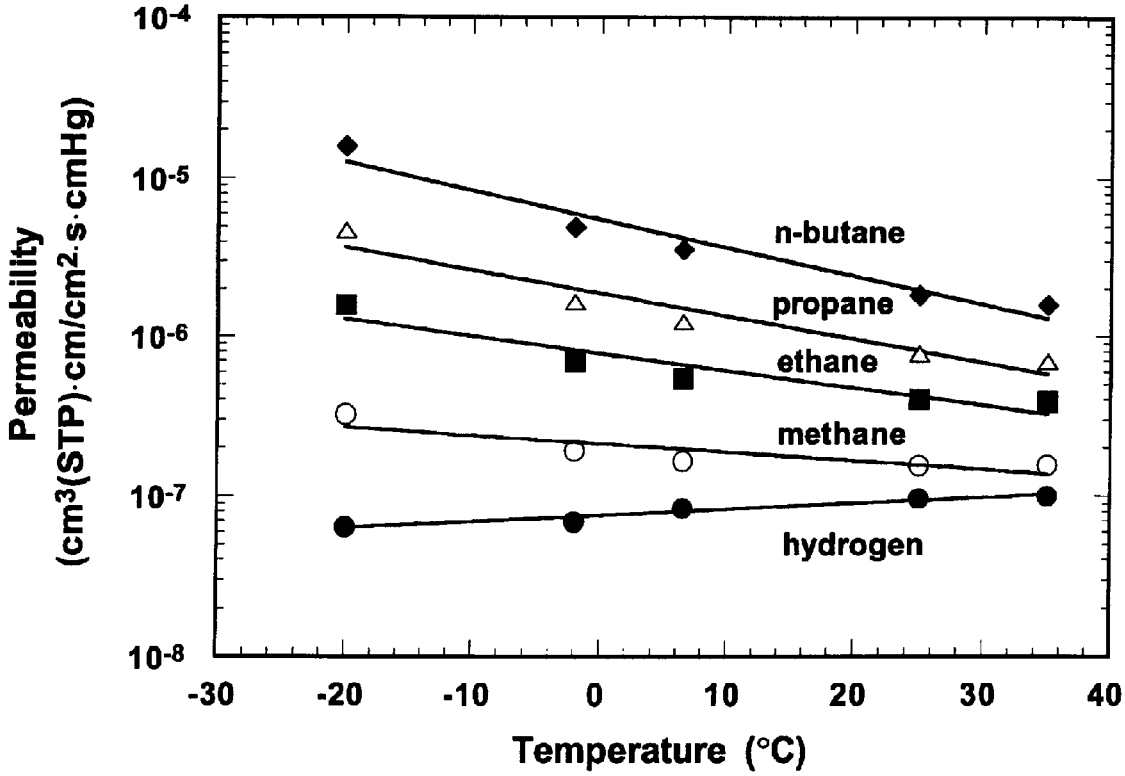
FIG. 7 is a graph showing the effect of temperature on the permeabilities of hydrogen, methane, ethane, propane and n-butane in a multicomponent gas mixture through a silicone rubber film.
Figure 8:
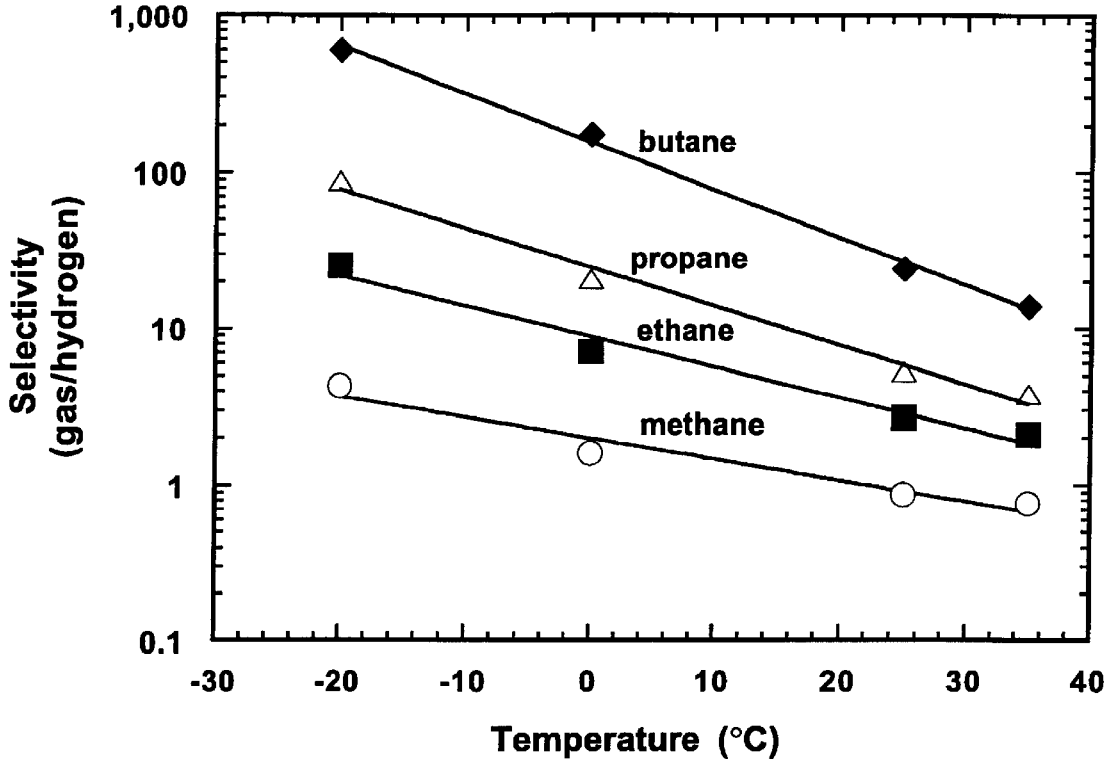
FIG. 8 is a graph showing the effect of temperature on the hydrocarbon/hydrogen selectivities of a silicone rubber film measured with a multicomponent gas mixture.

Permeability and selectivity results are shown in FIGS. 7 and 8, respectively, as a function of temperature. The permeabilities of both methane and hydrogen were higher at 35° C. in the multicomponent mixture than in the binary mixture. The permeability of hydrogen showed the same trend in the multicomponent mixture as in the binary mixture; that is, it decreased with decreasing temperature. The permeabilities of methane, ethane, propane and n-butane increased with decreasing feed temperature. For the most condensable gas, n-butane, the permeability increase was about 10-fold, from about 20,000 Barrer at 35° C. to about 200,000 Barrer at −20° C. The methane permeability almost doubled, from about 1,500 Barrer to about 3,000 Barrer, as the temperature was lowered from 35° C. to −20° C. This is an unexpected result, and the opposite from the trend in the binary mixture case, where decreasing the temperature also decreased the methane permeability.

As a result, the mixed-gas hydrocarbon/hydrogen selectivities increased significantly as the feed temperature decreased, as shown in FIG. 8. The methane/hydrogen selectivity increased from about 1.4 at 35° C. to about 5 at −20° C.

Examples 5–7

Comparative calculations were carried out to contrast the performance of the invention with prior art unselective purging. The calculations were performed using a modeling program, ChemCad III (ChemStations, Inc., Houston, Tex.), to simulate the treatment of a typical off-gas stream from a phase separator of a hydrocracker process.

The off-gas stream from the phase separator was assumed to have a flow rate of 50 MMscfd, to be at a temperature of 25° C. and a pressure of 1,800 psia, and have the following composition:

| | |
|---|---|
| Hydrogen | 74.5% |
| Methane | 17.5% |
| Ethane | 6.5% |
| Propane | 1.5% |

Example 5

Not in Accordance With The Invention

The prior art process was assumed to be carried out simply by withdrawing 8%, or 4 MMscfd, of gas from the separator overhead, and recirculating the remaining 46 MMscfd to the reactor. The compositions of the purge gas and recycle gas streams are, of course, the same in the unselective purge process. The results of the calculations are shown in Table 1.

TABLE 1

| Component/Parameter | Separator Off-Gas | Recycle Stream | Purge Stream |
|---|---|---|---|
| Mass Flow Rate (lb/h) | 40,185 | 36,968 | 3,217 |
| Temperature (° C.) | 50 | 50 | 50 |
| Pressure (psia) | 1,800 | 1,800 | 1,800 |
| Component (mol %) | | | |
| Hydrogen | 74.5 | 74.5 | 74.5 |
| Methane | 17.5 | 17.5 | 17.5 |
| Ethane | 6.5 | 6.5 | 6.5 |
| Propane | 1.5 | 1.5 | 1.5 |
| Component (lb/h) | | | |
| Hydrogen | 8,714 | 8,017 | 696.9 |
| Methane | 16,291 | 14,986 | 1,305 |
| Ethane | 11,342 | 10,434 | 908.2 |
| Propane | 3,838 | 3,531 | 307.4 |

In this case, the purge removed about 2,500 lb/h of hydrocarbons (1,305 lb/h methane, 908 lb/h ethane, and 307 lb/h propane) from the loop, with a concomitant loss of about 700 lb/h of hydrogen.

Example 6

A computer calculation was performed to simulate the process of the invention applied to the same off-gas stream as in Example 5. The treatment process was assumed to be carried out according to the process design shown in FIG. 2, that is, with the membrane separation step treating only part of the gas from the phase separator overhead, corresponding to the 4 MMscfd of gas that was purged in the prior art case of Example 5. It was further assumed that:

(i) no gas is discharged through line 218, (ii) no additional compression is required (compressor 210 not used), (iii) stream 209 is cooled to −10° C.; this does not result in hydrocarbon condensation, so no liquid is discharged through line 212, and (iv) hydrogen-rich stream 216 is recirculated to the hydrocracker.

The calculation was carried out to produce a total hydrocarbon removal of about 2,500 lb/h, as in the unselective purge process of Example 5.

The membrane separation step was assumed to be carried out using a silicone rubber membrane under conditions that yield a methane/hydrogen selectivity of 2.5. Membrane pressure-normalized fluxes were assumed to be as follows:

| | |
|---|---|
| Hydrogen | $100 \times 10^{-6}$ cm$^3$(STP)/cm$^2$ · sec · cmHg |
| Methane | $250 \times 10^{-6}$ cm$^3$(STP)/cm$^2$ · sec · cmHg |
| Ethane | $1,000 \times 10^{-6}$ cm$^3$(STP)/cm$^2$ · sec · cmHg |
| Propane | $2,000 \times 10^{-6}$ cm$^3$(STP)/cm$^2$ · sec · cmHg |

The results of the calculations are shown in Table 2. The stream numbers correspond to FIG. 2.

TABLE 2

| Component/Parameter | Stream 209 (Off-Gas Stream) | Stream 216 (Recycle Stream) | Stream 215 (Permeate Stream) |
|---|---|---|---|
| Mass Flow Rate (lb/h) | 8,043 | 5,385 | 2,658 |
| Temperature (° C.) | 10 | −16 | −16 |
| Pressure (psia) | 1,800 | 1,800 | 50 |
| Component (mol %) | | | |
| Hydrogen | 74.5 | 79.8 | 44.2 |
| Methane | 7.5 | 16.4 | 23.8 |
| Ethane | 6.5 | 3.4 | 24.3 |
| Propane | 1.5 | 0.4 | 7.7 |
| Component (lb/h) | | | |
| Hydrogen | 1,742 | 1,588 | 154.0 |
| Methane | 3,262 | 2,602 | 659.9 |
| Ethane | 2,271 | 1,010 | 1,261 |
| Propane | 768.4 | 185.0 | 583.4 |

Membrane Area = 30 m$^2$

In this case, removal of 2,500 lb/h of hydrocarbons was achieved with a loss of only 150 lb/h of hydrogen, that is, about 20% of the hydrogen loss of the prior art unselective purge. As a result, the hydrogen concentration in the recycle stream is increased from 74.5% to 79.8%.

Example 7

The computer calculation of Example 6 was repeated, except that the membrane area was increased to produce a permeate purge of about 1,300 lb/h of methane, as in the unselective purge process of Example 5. In other words, it was assumed that methane was the principal contaminant of concern.

The feed flow rate, stream composition, and all other conditions were as in Example 6.

The results of the calculations are shown in Table 3. The stream numbers correspond to FIG. 2.

TABLE 3

| Component/Parameter | Stream 209 (Off-Gas Stream) | Stream 216 (Recycle Stream) | Stream 215 (Permeate Stream) |
|---|---|---|---|
| Mass Flow Rate (lb/h) | 8,043 | 3770 | 4273 |
| Temperature (° C.) | 10 | −19 | −19 |
| Pressure (psia) | 1,800 | 1,800 | 50 |
| Component (mol %) | | | |
| Hydrogen | 74.5 | 83.9 | 50.4 |
| Methane | 17.5 | 14.6 | 25.0 |
| Ethane | 6.5 | 1.5 | 19.4 |
| Propane | 1.5 | 0.1 | 5.1 |
| Component (lb/h) | | | |
| Hydrogen | 1,742 | 1,412 | 330.0 |
| Methane | 3,262 | 1,955 | 1,306 |
| Ethane | 2,271 | 369.6 | 1,901 |
| Propane | 768.4 | 32.7 | 735.7 |

Membrane Area = 64 m$^2$

This process design results in a loss of about 300 lb/h of hydrogen, or about 40% of the hydrogen loss of the unselective purge process of Example 5. Because the membrane has a higher selectivity for ethane and propane over hydrogen than for methane over hydrogen, the ethane and propane removal in this case is higher than in Example 5, so the total hydrocarbon removal increases to nearly 4,300 lb/h. These hydrocarbons provide increased LPG production. In addition, the hydrogen concentration in the hydrogen recycle stream is increased from 74.5% to 83.9%.

Example 8

A computer calculation was performed to illustrate the process of the invention applied to the treatment of part of an overhead purge stream from the first phase separator of a catalytic reformer train. The purge stream was assumed to be divided into two portions, one of which is sent directly to the recontactor section, and the other is treated by membrane separation. The calculations were performed using a modeling program ChemCad III (ChemStations, Inc., Houston, Tex.).

The purge stream was assumed to be at a temperature of 10° C. and a pressure of 70 psia, and to have the following composition:

| | |
|---|---|
| Hydrogen | 76.9% |
| Methane | 3.4% |
| Ethane | 2.6% |
| Propane | 6.7% |
| n-Butane | 7.2% |
| n-Pentane | 3.2% |

The stream was assumed to be compressed to 300 psia in compressor 210 and then cooled to −10° C. The membrane separation step was assumed to be carried out using a silicone rubber membrane capable of exhibiting a methane/hydrogen selectivity of 2.5 under the conditions of the process. Membrane pressure-normalized fluxes were assumed to be as follows:

| | |
|---|---|
| Hydrogen | $100 \times 10^{-6}$ cm$^3$(STP)/cm$^2$ · sec · cmHg |
| Methane | $250 \times 10^{-6}$ cm$^3$(STP)/cm$^2$ · sec · cmHg |
| Ethane | $1{,}000 \times 10^{-6}$ cm$^3$(STP)/cm$^2$ · sec · cmHg |
| Propane | $2{,}000 \times 10^{-6}$ cm$^3$(STP)/cm$^2$ · sec · cmHg |
| n-Butane | $5{,}000 \times 10^{-6}$ cm$^3$(STP)/cm$^2$ · sec · cmHg |
| n-Pentane | $7{,}000 \times 10^{-6}$ cm$^3$(STP)/cm$^2$ · sec · cmHg |

The results of the calculations are shown in Table 4. Stream numbers correspond to FIG. 2.

TABLE 4

| Component/Parameter | Stream 209 | Stream 212 | Stream 213 | Stream 215 | Stream 216 |
|---|---|---|---|---|---|
| Mass Flow Rate (lb/h) | 13,705 | 7,485 | 6,220 | 2,195 | 4,025 |
| Temperature (° C.) | 10 | −10 | −10 | −11 | −11 |
| Pressure (psia) | 70 | 300 | 300 | 50 | 300 |
| Component (mol %) | | | | | |
| Hydrogen | 76.9 | 1.3 | 87.1 | 63.4 | 90.9 |
| Methane | 3.4 | 0.6 | 3.8 | 5.5 | 3.5 |
| Ethane | 2.6 | 3.0 | 2.5 | 7.4 | 1.8 |
| Propane | 6.7 | 23.6 | 4.4 | 15.3 | 2.7 |
| n-Butane | 7.2 | 46.4 | 1.9 | 7.4 | 1.0 |
| n-Pentane | 3.2 | 25.1 | 0.2 | 1.0 | 0.1 |
| Component (lb/h) | | | | | |
| Hydrogen | 1,722 | 3.6 | 1718 | 173.9 | 1544 |
| Methane | 606.6 | 11.9 | 594.7 | 120.5 | 474.2 |
| Ethane | 869.5 | 119.0 | 750.5 | 302.4 | 448.0 |
| Propane | 3,286 | 1,380 | 1,906 | 916.4 | 989.2 |
| n-Butane | 4,654 | 3,572 | 1,082 | 587.8 | 494.7 |
| n-Pentane | 2,566 | 2,399 | 168.6 | 93.9 | 74.8 |

Membrane Area = 200 m$^2$
Actual Horsepower = 748 hp

Hydrogen-enriched stream 216 contains over 90% hydrogen and could be returned to the reformer reactors. Stream 212, comprising 95% $C_{3+}$ hydrocarbons, could be returned to the first phase separator to increase reformate recovery, and permeate stream 215 could be sent to the recontactor for additional fractionation.

We claim:

1. A process comprising the following steps:

(a) reacting a hydrocarbon and hydrogen in a reactor;

(b) withdrawing an effluent stream comprising hydrogen, methane and a $C_{3+}$ hydrocarbon from the reactor;

(c) separating a vapor phase comprising hydrogen, methane and a $C_{3+}$ hydrocarbon from the effluent stream;

(d) passing at least a portion of the vapor phase as a feed stream across the feed side of a rubbery polymeric membrane having a feed side and a permeate side, and being selectively permeable to methane over hydrogen, under conditions sufficient that the membrane exhibits a methane/hydrogen selectivity of at least about 2.5;

(e) withdrawing from the permeate side a permeate stream enriched in methane and $C_+$ hydrocarbon compared with the vapor phase;

(f) withdrawing from the feed side a residue stream enriched in hydrogen compared with the vapor phase.

2. The process of claim 1, wherein the separating step (c) comprises cooling at least a portion of the effluent stream.

3. The process of claim 2, wherein the cooling is performed in multiple stages.

4. The process of claim 1, wherein a first portion of the vapor phase is recirculated to step (a) and a second portion of the vapor phase is sent to step (d).

5. The process of claim 1, wherein the polymeric membrane comprises silicone rubber.

6. The process of claim 1, wherein the polymeric membrane comprises a polysiloxane.

7. The process of claim 1, wherein the selectivity exhibited in step (d) is at least about 3.

8. The process of claim 1, wherein the selectivity exhibited in step (d) is at least about 4.

9. The process of claim 1, further comprising cooling the feed stream prior to passing the feed stream across the feed side.

10. The process of claim 9, wherein the cooling results in condensation of a liquid hydrocarbon fraction and wherein the liquid hydrocarbon fraction is removed from the feed stream prior to passing the feed stream across the feed side.

11. The process of claim 1, further comprising recirculating at least a portion of the residue stream to step (a).

12. The process of claim 1, further comprising recirculating at least a portion of the permeate stream to step (c).

13. A process comprising the following steps:

(a) reacting a hydrocarbon and hydrogen in a reactor;

(b) withdrawing an effluent stream comprising hydrogen, methane and a $C_{3+}$ hydrocarbon from the reactor;

(c) separating a vapor phase comprising hydrogen, methane and a $C_{3+}$ hydrocarbon from the effluent stream;

(d) passing at least a portion of the vapor phase as a first feed stream across the first feed side of a first polymeric membrane having a first feed side and a first permeate side, and being selectively permeable to $C_{2+}$ hydrocarbons over hydrogen;

(c) withdrawing from the first permeate side a first permeate stream enriched in $C_{3+}$ hydrocarbons compared with the vapor phase;

(f) withdrawing from the first feed side a first residue stream enriched in hydrogen compared with the vapor phase;

(g) passing the first residue stream as a second feed stream across the second feed side of a second rubbery polymeric membrane having a second feed side and a second permeate side, and being selectively permeable to methane over hydrogen, under conditions sufficient that the membrane exhibits a methane/hydrogen selectivity of at least about 2.5;

(h) withdrawing from the second permeate side a second permeate stream enriched in methane and $C_{3+}$ hydrocarbons compared with the first residue stream;

(i) withdrawing from the second feed side a second residue stream enriched in hydrogen compared with the first residue stream.

14. The process of claim 13, wherein the selectivity exhibited in step (g) is at least about 3.

15. The process of claim 13, further comprising cooling the feed stream prior to passing the feed stream across the first feed side.

16. The process of claim 15, wherein the cooling results in condensation of a liquid hydrocarbon fraction and wherein the liquid hydrocarbon fraction is removed from the feed stream prior to passing the feed stream across the first feed side.

17. The process of claim 15, wherein the cooling does not lower the temperature of the feed stream below 0° C.

18. The process of claim 13, further comprising cooling the first residue stream prior to passing the first residue stream across the second feed side.

19. The process of claim 13, further comprising recirculating at least a portion of the second residue stream to step (a).

20. The process of claim 13, further comprising recirculating at least a portion of the first permeate stream to step (c).

* * * * *